US007628660B2

(12) United States Patent
Ma

(10) Patent No.: US 7,628,660 B2
(45) Date of Patent: Dec. 8, 2009

(54) BATTERY CONNECTOR HAVING A BRACKET

(75) Inventor: Zhong-Jun Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/004,974

(22) Filed: Dec. 21, 2007

(65) Prior Publication Data

US 2008/0153359 A1 Jun. 26, 2008

(30) Foreign Application Priority Data

Dec. 22, 2006 (CN) ..... 200620170606

(51) Int. Cl.
*H01R 4/48* (2006.01)

(52) U.S. Cl. ..... 439/862

(58) Field of Classification Search ..... 439/658, 439/862, 500, 754, 367, 607, 609, 573, 660
See application file for complete search history.

(56) References Cited

U.S. PATENT DOCUMENTS 5,035,651 A * 7/1991 Dixon et al. ..... 439/609
5,387,114 A * 2/1995 Brunker et al. ..... 439/108
5,772,471 A * 6/1998 Buck ..... 439/607
5,797,770 A * 8/1998 Davis et al. ..... 439/607
6,159,039 A * 12/2000 Wu ..... 439/541.5
6,948,980 B2 * 9/2005 Xiang et al. ..... 439/607
6,951,488 B2 * 10/2005 Hsieh ..... 439/660
7,357,665 B1 * 4/2008 Yan ..... 439/500
2004/0092171 A1 * 5/2004 Yu ..... 439/676

* cited by examiner

*Primary Examiner*—Chandrika Prasad
(74) *Attorney, Agent, or Firm*—Ming Chieh Chang; Wei Te Chung; Andrew C. Cheng

(57) ABSTRACT

An electrical connector for mounting on a printed circuit board, comprising: an insulating housing defining a first mating face and a second mating face adjacent to each other, and a top surface opposite to the second mating face, a plurality of passages extending from the second mating face toward the top surface and communicating with the first mating face, an imaginary central line extending through the top surface of the housing along lengthwise direction. A plurality of contact terminals received in the passages and each including a mounting portion securely positioned within the corresponding passage, each contact terminals including a contacting point extending from the mounting portion and out of the first mating surface, and a terminating end portion extending also from the mounting portion and away from the passage. A bracket attached to the body for securing the housing onto a printed circuit board, having a body portion pressing against the top surface of the housing, a strengthening tab extending transversely along an edge of the body portion and across over the imaginary line of the top surface effectively reducing tilting of the connector when mated with a battery.

4 Claims, 5 Drawing Sheets

BATTERY CONNECTOR HAVING A BRACKET

BACKGROUND OF THE INVENTION

1. Field of the Invention

This invention relates to the art of electrical connectors and, particularly, to a circuit board mounted electrical connector which includes bracket for strengthening the securement of the connector to the board. The bracket includes a tab extending over an imaginary central line of a housing of the connector thereby effectively reducing tilting of the connector when the connector is mated with a battery.

2. Description of Related Art

In normal electronic devices, such as a cell phone, usually uses a battery connector to provide an electrical connection between the printed circuit board of one of the electronic devices and a battery.

A conventional battery connector in the market, which includes a dielectric housing having a plurality of terminal-receiving passages or cavities for receiving a plurality of terminals. The passages are separated by interior side walls, and each passage terminates in a bottom or base wall.

Each terminal of the battery connector includes a contact portion joined to a base portion by a V-shaped spring portion. A plurality of teeth project outwardly from each side edge of base portion for skiving into the side walls of passages to secure the terminals in the passages. When the terminals are fully inserted into passages, the contact portions of the terminals are exposed above a top mating face of the housing and terminating ends of the terminals are exposed at a bottom face of the housing. The contact portions resiliently or yieldably engage the contacts of a complementary connecting device, and terminating ends of the terminals are connected, as by soldering, to appropriate circuit traces on a printed circuit board.

SUMMARY OF THE INVENTION

An object, therefore, of the invention is to provide a new and improved electrical connector of the character described for mounting on a printed circuit board.

In the exemplary embodiment of the invention, the electrical connector for mounting on a printed circuit board, comprising: an insulating housing defining a first mating face and a second mating face adjacent to each other, and a top surface opposite to the second mating face, a plurality of passages extending from the second mating face toward the top surface and communicating with the first mating face, an imaginary central line extending through the top surface of the housing along lengthwise direction. A plurality of contact terminals received in the passages and each including a mounting portion securely positioned within the corresponding passage, each contact terminals including a contacting point extending from the mounting portion and out of the first mating surface, and a terminating end portion extending also from the mounting portion and away from the passage. A bracket attached to the body for securing the housing onto a printed circuit board, having a body portion pressing against the top surface of the housing, a strengthening tab extending transversely along an edge of the body portion and across over the imaginary line of the top surface effectively reducing tilting of the connector when mated with a battery.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
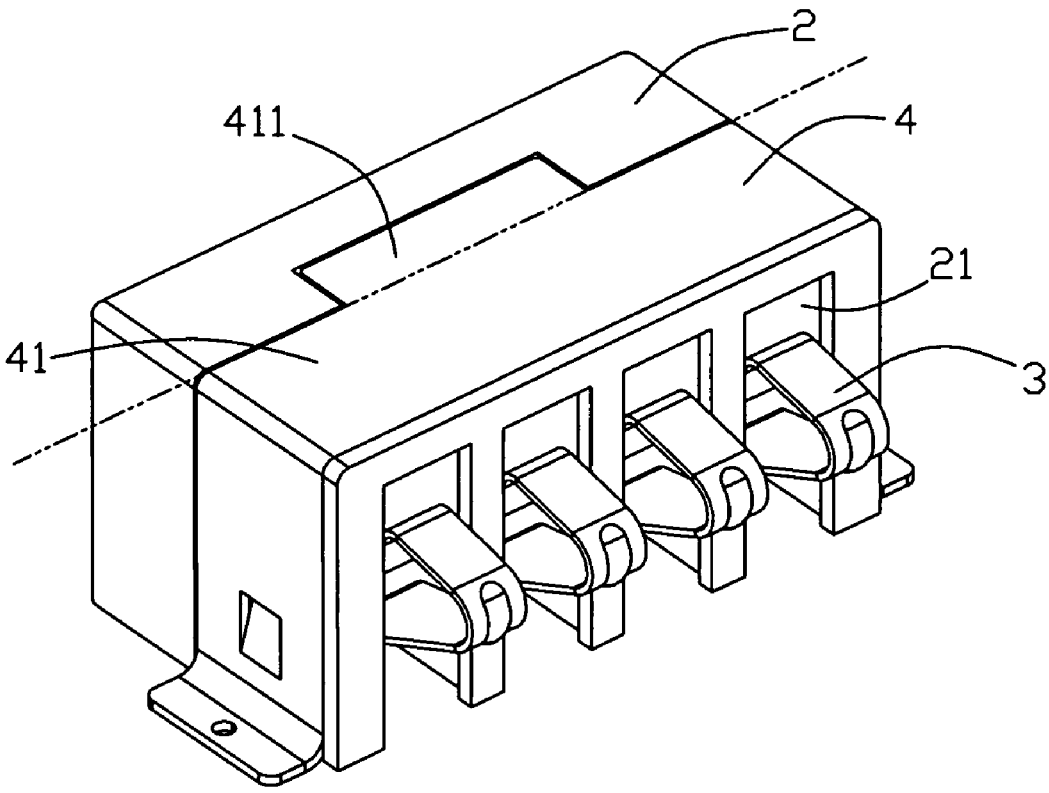
FIG. 1 is an assembled view of an electrical connector in accordance with the present invention.

While the invention may be embodied in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
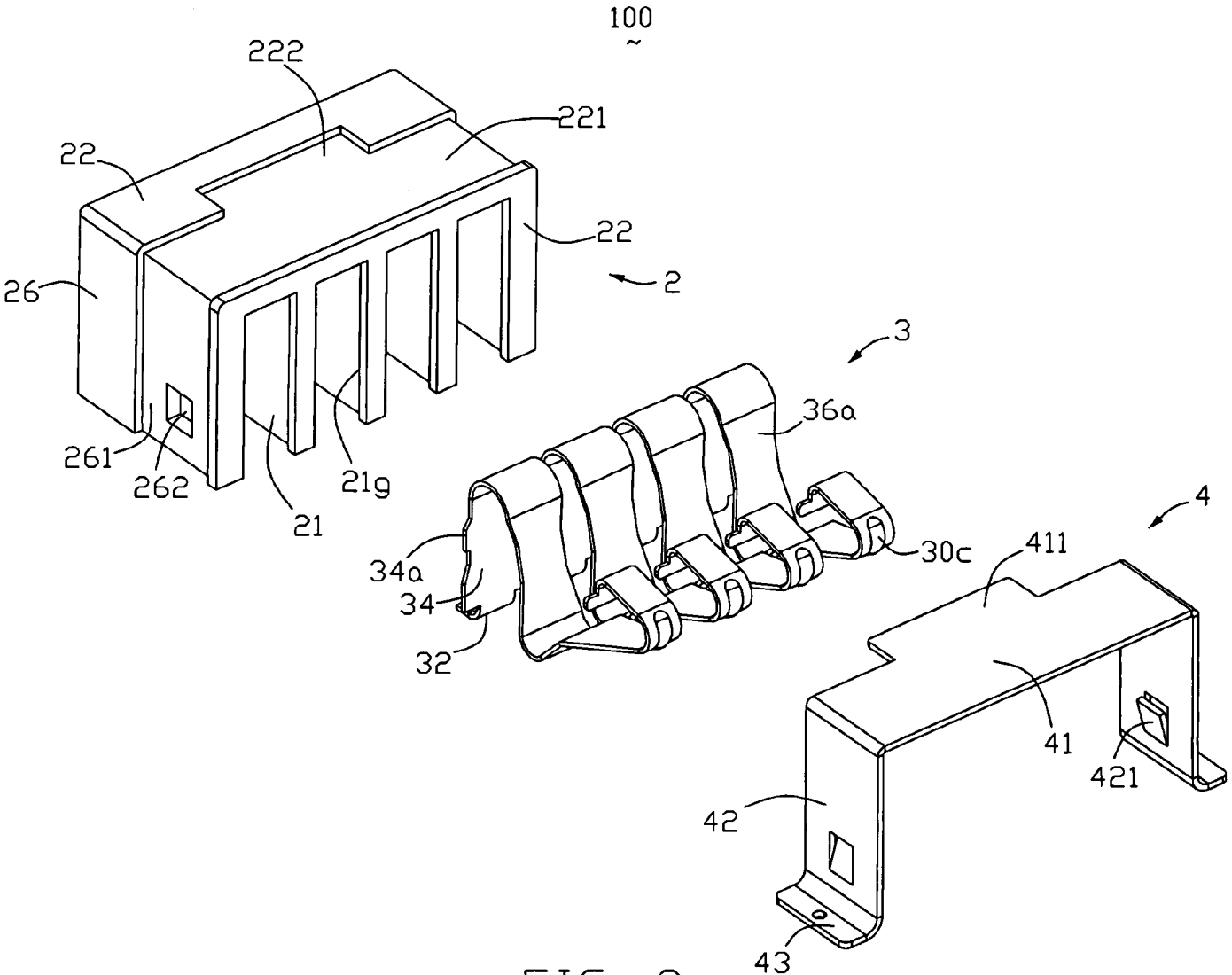
FIG. 2 is an exploded, isometric view of the electrical connector.
Figure 3:
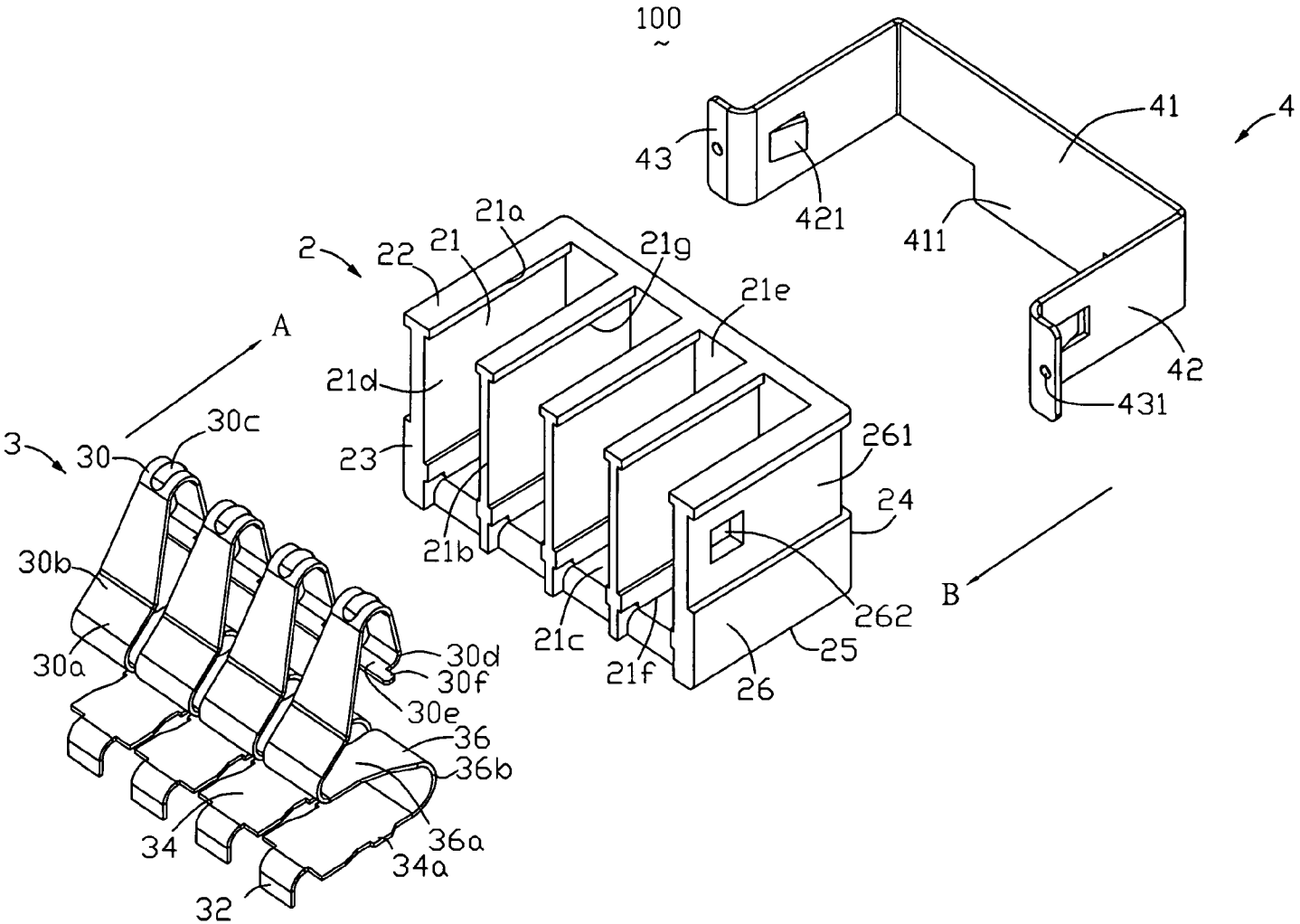
FIG. 3 is an exploded, isometric view of other angle of the FIG. 2.

Referring to the drawings in greater detail, and first to FIGS. 1 to 3, the invention is embodied in a battery type electrical connector, generally designated 100, which includes a insulating housing, generally designated 2. The housing 2 has a plurality of terminal-receiving passages, generally designated 21, for receiving a plurality of contact terminals, generally designated 3. Besides, the electrical connector 100 has a bracket 4 for mounting the connector 100 on a printed circuit board (not labeled).

Housing 2 is a one-piece structure unitarily molded of dielectric material such as plastic or the like. The housing 2 includes a first mating face 22 which is generally perpendicular to a second mating face 23, a top surface 24 opposite to the second mating face 23, a rear surface 25 opposite to the first mating face 22 and two opposite side faces 26 respectively connecting the top surface 24 and the second mating face 23. Each terminal-receiving passage 21 is open, as at 21*a*, in the first mating face 22 and is open, as at 21*b*, in the second mating face 23. Each passage includes a bottom wall 21*c*, a pair of opposite side walls 21*d* and an interior base wall 21*e*. A securing groove 21*f* is formed in each side wall 21*d*. The first mating face 22 has a first pitting portion 221 extending along the longitudinal direction thereof. The first pitting portion 221 combines with two second pitting portions 261 respectively extending along the longitudinal direction of the side faces 26 to form a generally inverting U-shaped configuration. An imaginary central line (not labeled) penetrates the top surface 24 of the housing 2 along lengthwise direction (FIG. 1), and said imaginary central line coinciding with the edge of the first pitting portion 221. A third pitting portion 222 extending over the imaginary central line of the housing 2 and communicating with the first pitting portion 221, and also having the same depth. In addition, the second pitting portion 261 has a receiving groove 262.

Each contact terminal 3 is stamped and formed of conductive sheet metal material and includes a contact end, generally designated 30, a terminating end or foot 32 and a mounting portion or plate 34 between the ends, along with a spring portion, generally designated 36 between the mounting plate 34 and the contact end 30. Terminating end or foot 32 is generally flat for connection, as by soldering, to an appropriate circuit trace on the printed circuit board. Mounting portion or plate 34 is inserted into the securing grooves 21*f* in the side walls 21*d* of a respective one of the terminal-receiving passages 21, as teeth 34*a* at opposite edges of the mounting plate 34 skive into the plastic material of the housing within grooves 21*f*. Spring portion 36 includes a spring plate 36*a* which is bent, as at 36*b*, back over the mounting plate 34. The contact end 30 is bent, as at 30*a*, back over the spring plate 36*a*. The contact end 30 includes a contact arm 30*b* which is bent upwardly to a contact point 30*c* and bent back downwardly, as at 30*d*, to a distal end 30*e* which defines a pair of outwardly projecting wings 30*f*. Thus, each contact terminal 3 has a generally S-shaped configuration.

When each contact terminal 3 is inserted into a respective one of the terminal-receiving passages 21 in the housing 2, in the direction of arrow "A" (FIG. 3), the mounting plate 34 and the teeth 34*a* ride into the securing grooves 21*f* in opposite side walls 21*d* of the passage 21. The Wings 30*f* of the contact end 30 ride under ledges 21*g* at the inner end of the passage 21. When the contact terminal 3 is fully inserted, the terminating end or foot 32 is exposed at the second mating face 23 of the housing 2, generally parallel thereto, for soldering to an appropriate circuit trace on the printed circuit board. Contact point 30*c* of the contact end 30 of the terminal 3 projects upwardly out of the top opening 21*a* of the passage 21 for engaging resiliently with an appropriate contact of a complementary connecting device.

Reinforcing member 4 is stamped and formed of sheet metal material and includes a body portion (not labeled) forming a generally inverting U-shaped. The body portion comprises a first mating portion 41 received in the first pitting portion 221 and two second mating portions 42 respectively extending downwardly from the opposite ends of the first mating portion 41 received in the second pitting portions 261. Because of the ubiety above mentioned, said imaginary central line also coinciding with the edge of the first mating portion 41, and a strengthening portion 411 extending over the imaginary central line of the electrical connector 100 thereby effectively reducing tilting of the electrical connector 100 when the electrical connector 100 is mated with a battery (not labeled). The strengthening portion 411 received in the third pitting portion 222. The second mating portion 42 has a spring tab 421 extending inwardly corresponding to the receiving groove 262 of the housing 2. In addition, a fixing portion 43 defined at the bottom end of each second mating portion 42 extending outwardly for mounting the connector 100 on the printed circuit board.

Figure 4:
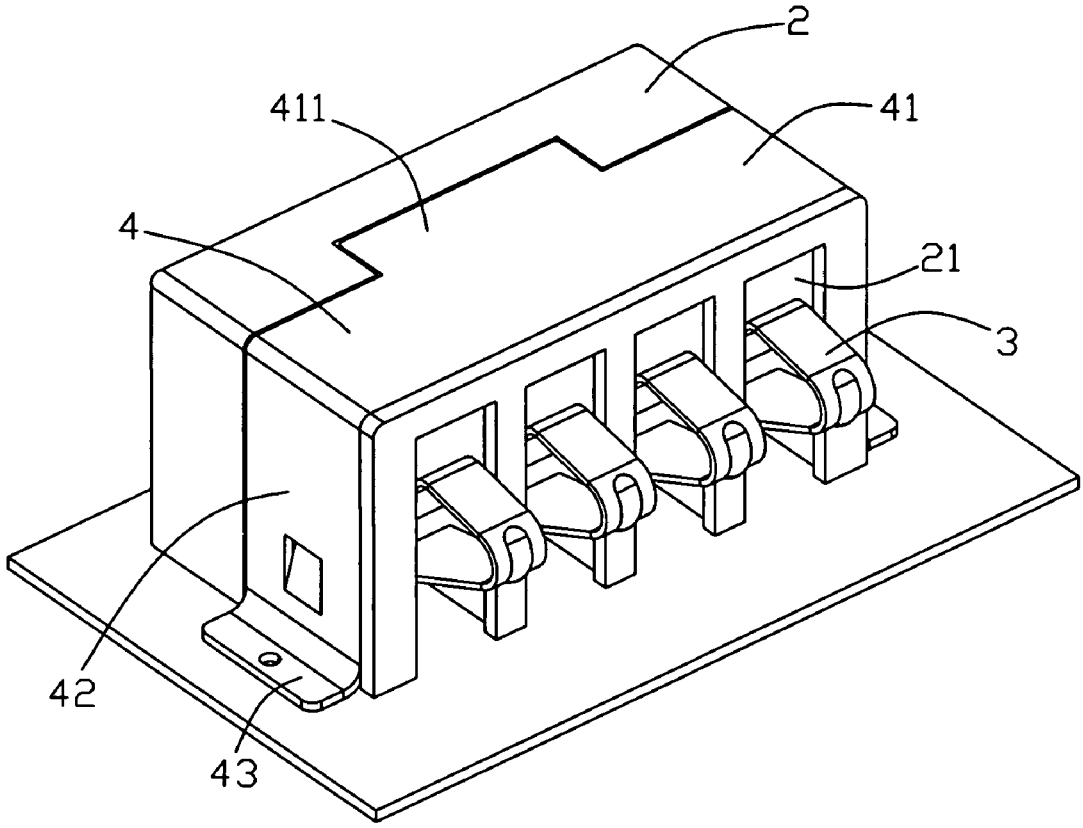
FIG. 4 is an assembled view of the electrical connector mounting on a printed circuit board by soldering.
Figure 5:
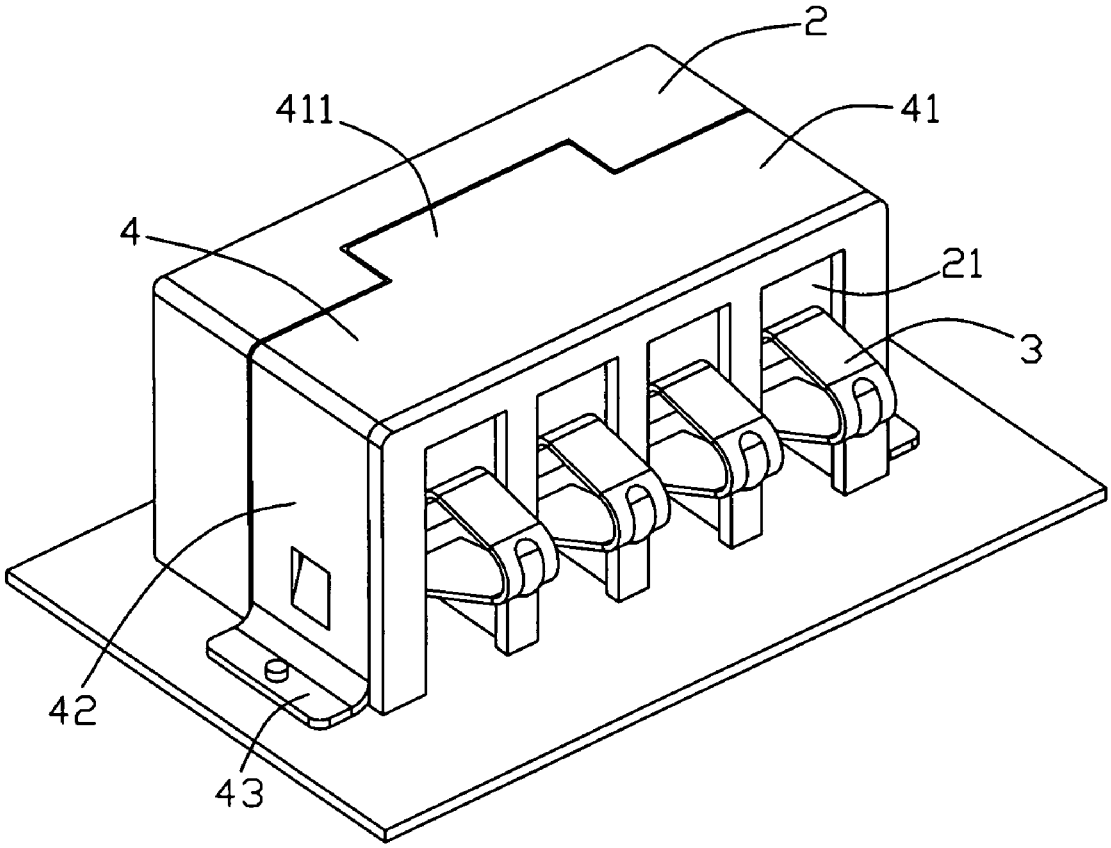
FIG. 5 is an assembled view of the electrical connector mounting on a printed circuit board by locking with locking element such as fastening means.

The bracket 4 is mounted onto the pitting portions of the housing 2, in the direction of arrow "B" (FIG. 3). When the bracket 4 is fully inserted (please referring to the FIG. 4 and FIG. 5 at the same time), the fixing portion 43 is generally parallel thereto, for soldering on the printed circuit board, or the fixing portion 43 may be has a hole 431 in the middle position of the fixing portion 43 so as to mount the electrical connector 100 in the printed circuit board by locking element such as a fastening means (not labeled).

In this invention, the electrical connector 100 includes the bracket 4 for securing the electrical connector 100 onto the printed circuit board, and the strengthening portion 411 extending from the bracket 4 for relieving an applied force and strengthening securement between the housing 2 and the bracket 4.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An electrical connector for mounting on a printed circuit board, comprising:

an insulating housing defining a first mating face and a second mating face adjacent to each other, and a top surface opposite to the second mating face, a plurality of passages extending from the second mating face toward the top surface and communicating with the first mating face, an imaginary central line extending through the top surface of the housing along lengthwise direction;

a plurality of contact terminals received in the passages and each including a mounting portion securely positioned within the corresponding passage, each contact terminals including a contacting point extending from the mounting portion and out of the first mating surface, and a terminating end portion extending also from the mounting portion and away from the passage; and a bracket attached to the housing for securing the housing onto the printed circuit board, the bracket having a T-shaped member formed with a body portion and a strengthening tab, said body portion pressing against the top surface of the housing, said strengthening tab extending transversely along an edge of the body portion and across over the imaginary line of the top surface effectively reducing tilting of the connector when mated with a battery; wherein the housing includes a rear surface opposite to the first mating face and two opposite side faces respectively connecting the top surface and the second mating face; wherein the housing defines a pitting portion corresponding to the bracket; wherein the body portion comprises a first mating portion and two second mating portions respectively extending downwardly from the opposite ends of the first mating portion; wherein each of the second mating portions defines a fixing portion extending outwardly; wherein each of the second mating portions has a spring tab extending inwardly for mounting the bracket on the housing firmly.

2. The electrical connector of claim 1, wherein the fixing portion generally coplanar with the terminating end of the contact terminal for soldering on the printed circuit board.

3. The electrical connector of claim 1, wherein a hole is defined in the middle position of the fixing portion for assembling the electrical connector in the printed circuit board with locking element such as fastening means.

4. An electrical connector assembly comprising:

an insulating housing defining a first mating face and a second mating face adjacent to each other, a top surface opposite to the second mating face, a plurality of passages extending from the second mating face toward the top surface and communicating with the first mating face, an imaginary central line extending through the top surface of the housing along lengthwise direction;

a plurality of contact terminals received in the passages and each in eluding a mounting portion securely positioned within the corresponding passage, each contact terminals including a contacting point extending from the mounting portion and out of the first mating surface, and a terminating end portion extending also from the mounting portion, and away from the passage;

a bracket attached to the housing for securing the housing onto a printed circuit board, the bracket having a T-shaped member formed with a body portion and a strengthening tab, said body portion pressing against the top surface of the housing, two fixing portions extending downwardly from the ends of the body portion respectively, said strengthening tab extending transversely along an edge of the body portion and across over the imaginary line of the top surface effectively reducing tilting of the connector when mated with a battery, the fixing portion having at least one assembling hole for assembling the connector on the printed circuit board;

the printed circuit board has at least one mating hole corresponding to the assembling hole of the bracket; and at least one fastening means extending from assembling hole of the bracket, and anchored to the mating hole of the printed circuit board;

wherein the housing includes a rear surface opposite to the first mating face and two opposite side faces respectively connecting the top surface and the second mating face; wherein the housing defines a pitting portion corresponding to the bracket; wherein the body portion comprises a first mating portion and two second mating portion respectively extending downwardly from the opposite ends of the first mating portion.

* * * * *